United States Patent [19]

Franz

[11] 4,072,772

[45] Feb. 7, 1978

[54] LINEAR CURTAIN SPRAY APPLICATOR

[75] Inventor: Helmut Franz, Pittsburgh, Pa.

[73] Assignee: PPG Industries, Inc., Pittsburgh, Pa.

[21] Appl. No.: 387,056

[22] Filed: Aug. 9, 1973

[51] Int. Cl.[2] ..... B05D 1/02; B05D 1/36; B05D 5/06

[52] U.S. Cl. ..... 427/164; 427/168; 427/299; 427/304; 427/305; 427/424

[58] Field of Search ..... 117/47 R, 54, 105.3, 117/124 C; 134/5, 32, 36, 72, 82, 131, 151, 198, 199; 118/73; 239/427.3, 550; 427/299, 304–306, 424, 444, 164, 168

[56] References Cited

U.S. PATENT DOCUMENTS

| | | | |
|---|---|---|---|
| 1,770,991 | 7/1930 | Offenbacher | 118/314 |
| 2,130,241 | 9/1938 | MacLaurin | 117/105.3 |
| 2,414,923 | 1/1947 | Batcheller | 117/105.3 |
| 2,551,538 | 5/1951 | Hensel | 239/550 |
| 2,570,299 | 9/1951 | Zademach | 118/73 |
| 2,598,391 | 5/1952 | Jones | 117/105.3 |
| 2,605,596 | 5/1952 | Uhri | 134/7 |
| 2,628,924 | 2/1953 | Johnston | 134/15 |
| 2,635,063 | 4/1953 | Dunlevy | 134/36 |
| 2,667,428 | 1/1954 | Young | 117/105.3 |
| 2,717,845 | 9/1955 | Carter | 134/2 |
| 2,815,298 | 12/1957 | Heffley | 117/105.3 |
| 2,960,061 | 11/1960 | Whitbeck | 118/73 |
| 3,024,139 | 3/1962 | Shoemaker | 134/15 |
| 3,428,023 | 2/1969 | Cox | 134/15 |
| 3,543,775 | 12/1970 | Bodnar | 134/15 |
| 3,544,366 | 12/1970 | Uhlmann | 134/36 |
| 3,723,155 | 3/1973 | Greenberg | 117/124 C |

*Primary Examiner*—James R. Hoffman
*Attorney, Agent, or Firm*—E. Kears Pollock; Donald Carl Lepiane

[57] ABSTRACT

A surface of an article is coated by moving the article downstream through a linear curtain spray rinse applicator and thereafter through a linear curtain spray coating applicator. The rinse applicator and coating applicator are positioned relative to one another such that the rinsing spray and coating spray intersect at the surface of the article. The rinsing medium is applied as a spray having upstream frontal forces lying in a plane generally parallel to the surface of the article to provide the surface with a uniform thickness of rinsing medium film. The coating medium is applied to the surface of the article having downstream frontal forces lying in a plane generally parallel with the surface of the article to prevent the rinsing medium mixed with coating medium from moving upstream into the coating spray. In this manner, the surface of the article is more uniformly coated.

3 Claims, 19 Drawing Figures

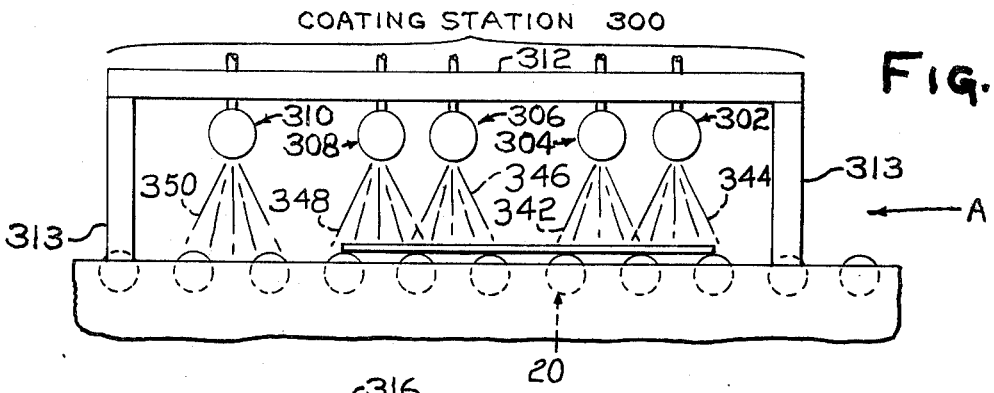
FIG. 12
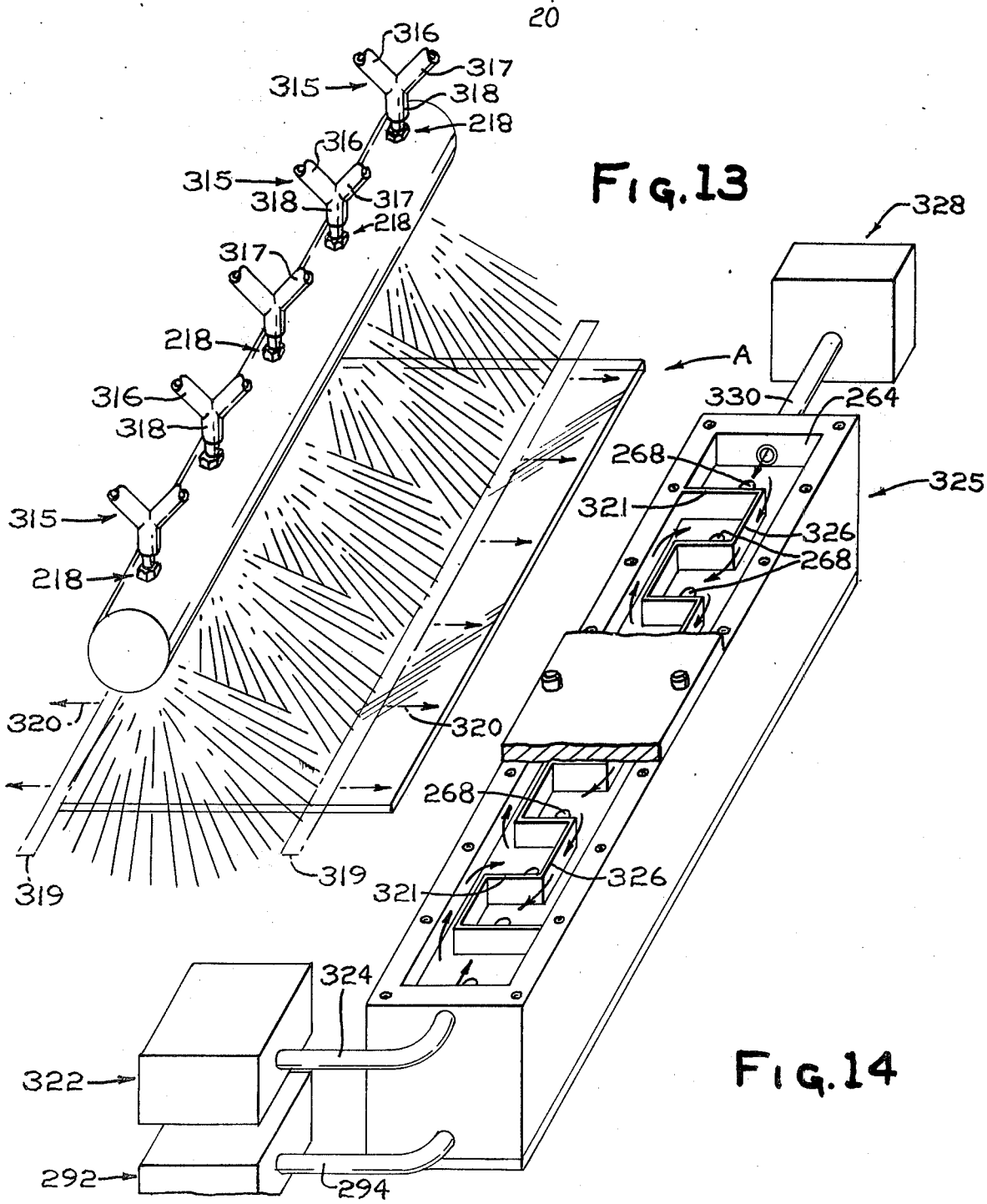
FIG. 13
FIG. 14

FIG. 17
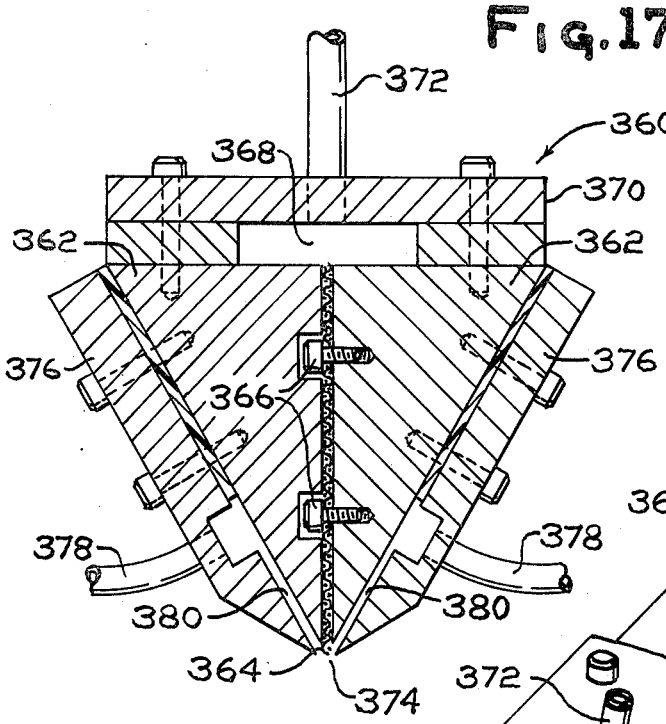
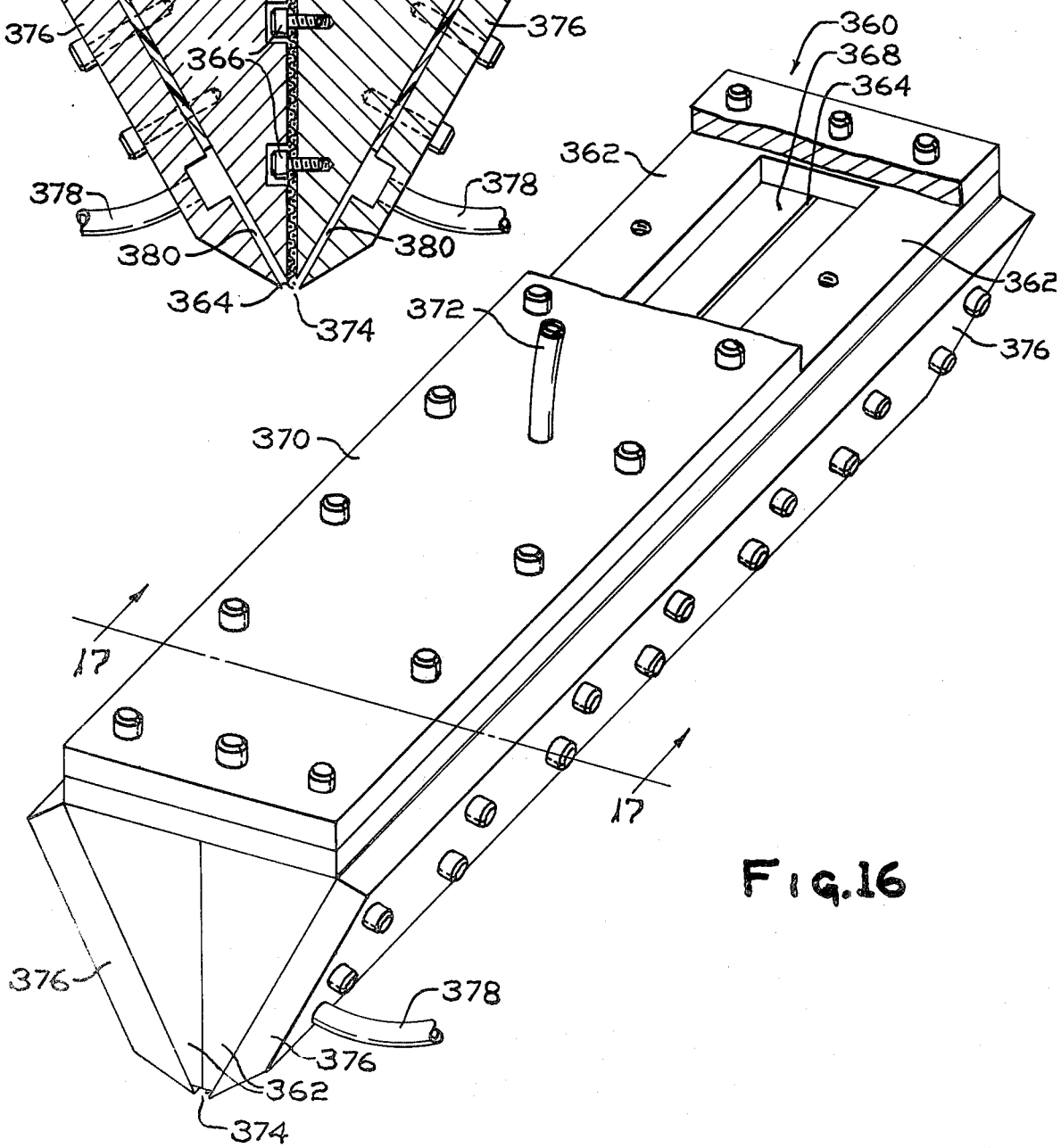
FIG. 16

LINEAR CURTAIN SPRAY APPLICATOR

CROSS REFERENCES TO RELATED APPLICATIONS

This application is related to U.S. Pat. Application Ser. No. 159,746, filed in the name of Helmut Franz and entitled "Angled Crossfire Rinses", filed on July 6, 1971, now U.S. Pat. No. 3,793,054, which patent is incorporated by reference.

BACKGROUND OF THE INVENTION

1. Field of the Invention:

This invention relates to a method of and apparatus for coating non-conductive substrates, e.g. glass, with transparent coatings having uniform optical properties.

2. Description of the Prior Art:

In general, transparent substrates are coated with a transparent metal film for use as transparent windows or outside walls in a building such as a skyscraper or other multi-story structure. These substrates may be especially advantageously employed as one of the plates which make up multiple glazed units. It will be appreciated that uniformity of coating in such cases is especially important because otherwise the reflected color portions of the building differ sharply from that of other portions, thus distracting from its appearance.

In general, the prior art teaches a process whereby glass plates are conveyed along an article movement path through a sequence of rinse sprays and coating sprays. After a plate is rinsed, normally with water, it is covered with a layer of water. When the plate enters the coating spray, this layer of water is normally pushed toward the trailing edge of the plate and tends to accumulate toward the trailing edge.

As more water accumulates at the trailing edge, the water tends to flow back into the coating spray. The problem is especially severe at the trailing edge where the water is retained by the edge of the plate. After reaching equilibrium thickness at the trailing edge, some of the water flows back into the coating spray so that the glass plate is sprayed while it is covered with one or more puddles of water of non-uniform thickness. As a result, there is an uneven dilution of the coating solution, causing the transparent coating on the plate to vary in thickness, in absorption and in reflectance. This is extremely pronounced adjacent to the trailing edge of the plate.

Other problems associated with the prior art process of coating a piece of glass are (1) finger-like fronts of sprayed-on solution form between each rinse spray and coating spray which manifests itself in streaks in the direction of travel of the plate; (2) splashing of the rinse medium in the coating area causes streaks and mottle in the coating and; (3) the spray nozzles disturb the rinse film in the spray coating zone making the rinse film non-uniform which causes the coating to vary in thickness, in absorption and in reflectance.

In U.S. Pat. Application Ser. No. 159,747, filed on July 6, 1971, in the name of the present inventor and entitled "Squeegee/Shield" and U.S. Pat. application Ser. No. 324,730, filed on Jan. 18, 1973, which is a division of U.S. Pat. application Ser. No. 159,747 now U.S. Pat. Nos. 3,761,305 and 3,782,328 respectively, there is disclosed a solution to the problem caused by the accumulation of water at the trailing edge and the finger-like fronts. In the above-mentioned applications, there is suggested the use of a squeegee/shield combination ahead of the coating spray to insure that there are no puddles or finger-like fronts of rinse water at the coating spray. The squeegee is made of soft rubber or plastic and it prevents the formation of finger-like fronts and also protects the glass surface from splashing and defects associated with splashing.

However, the squeegee/shield combination has limitations. For example, there is always a chance of damaging the coated layers on the surface when solid particles become trapped between the glass and the squeegee or in the squeegee material itself abrading the surface layers.

In U.S. Pat. No. 3,793,054 there is disclosed another solution to the problem of accumulation of water at the trailing edge and the finger-like fronts as well as eliminating the problem of the particles abrading the surface. A reciprocating crossfire set of rinsing facilities rinses the surface of the glass sheet while maintaining a uniform thickness of rinsing medium in an area on the glass surface where a subsequent spray coating operation is to be carried out. The rinsing facilities are arranged such that the rinsing medium spray is angled obliquely downward, rearward and outward and the rinsing medium is supplied at a rate sufficient to force excess rinsing medium off the side and the trailing edge of the sheet rather than being delivered into the spray coating zone or accumulating along the trailing edge portion of the plate. The finger-like puddles are eliminated by moving the coating spray and the crossfire set of rinsing facilities in unison and positioning the coating spray and rinsing spray relative to one another such that the rinse spray and coating spray intercept about $\frac{1}{8}$ to $\frac{1}{4}$ inch at the surface of the glass.

Although the angled crossfire rinse eliminates the problems of streaking and puddling in addition to abrading, there are limitations. More particularly, during reciprocation, a zigzag spray pattern results from the transverse movement of the coating spray and the forward movement of the conveyor. Setting practical speed limits on both variables plus the interaction between the transversing rinsing and coating sprays has been found to be critical for uniform coatings. Further, experience has taught that fast-moving transverse bridges can create serious wear and tear, as well as maintenance and contamination problems. In addition, in order to eliminate puddles in the coating zone, the rinsing spray intercepts about $\frac{1}{8}$ to $\frac{1}{4}$ of the coating spray. To maintain this arrangement requires considerable care in arranging the angled crossfire rinsing sprays and the coating sprays.

SUMMARY OF THE INVENTION

In general, this invention relates to a method of controlling thickness of a working fluid medium on a surface of an article to provide the surface with a uniform thickness of the working fluid medium. A film of working fluid medium, e.g. rinsing medium, sensitizing solution, activating solution or coating solution, is applied to the surface of the article. Generally, unidirectional forces are applied to the working fluid medium on the surface as the article and the applied forces are displaced relative to one another. The applied forces lie in a plane generally parallel and spaced from the surface of the article and act on the working fluid medium on the surface to provide a uniform film of working medium on the surface.

This invention also relates to an improved method of coating a surface of an article wherein the surface is coated by providing a spray of rinsing medium and a spray of coating medium. The coating medium spray is in a downstream direction relative to the rinsing medium spray. The article and the sprays are displaced relative to one another to sequentially apply the rinsing medium to the surface to rinse the surface and apply the coating medium to the rinsed surface to coat the surface of the article. The improvement includes applying upstream forces to the rinsing medium on the surface of the article in a plane generally parallel to and spaced from the surface of the article to move the rinsing medium generally upstream unidirectionally along the surface of the article to provide a rinsing medium film of uniform thickness on at least a portion of the surface of the article to be coated.

The forces may be applied to the rinsing medium on the surface by applying either the rinsing medium or the coating medium, e.g. an activating solution, a sensitizing solution or a metal coating solution, as a spray having generally upstream unidirectional forces lying in a plane generally parallel to the surface of the article.

This invention also relates to an apparatus for carrying out the method of this invention.

BRIEF DESCRIPTION OF THE DRAWING

FIG. 12 is a diagrammatic partial elevation of the coating station of the apparatus of FIG. 1 employing the principles of the invention;

FIG. 13 is an isometric view of an alternate embodiment of a linear curtain spray applicator for spraying a coating solution to a surface of an article such that the spray has generally upstream and downstream unidirectional forces lying in a plane generally parallel to the surface of the article, according to the teachings of the invention;

FIG. 14 is an isometric view of still another embodiment of a linear curtain spray applicator having portions cut away for purposes of clarity for spraying the coating solution on a surface of an article such that the spray has generally upstream and downstream unidirectional forces lying in a plane generally parallel to the surface of the article, according to the teachings of the invention;

FIG. 16 is an isometric view of still another embodiment of a linear curtain spray applicator embodying the principles of this invention and having portions cut away for purposes of clarity;

FIG. 17 is a sectional view taken along lines 17—17 of FIG. 16.

DESCRIPTION OF THE INVENTION

Figures 1, 2:
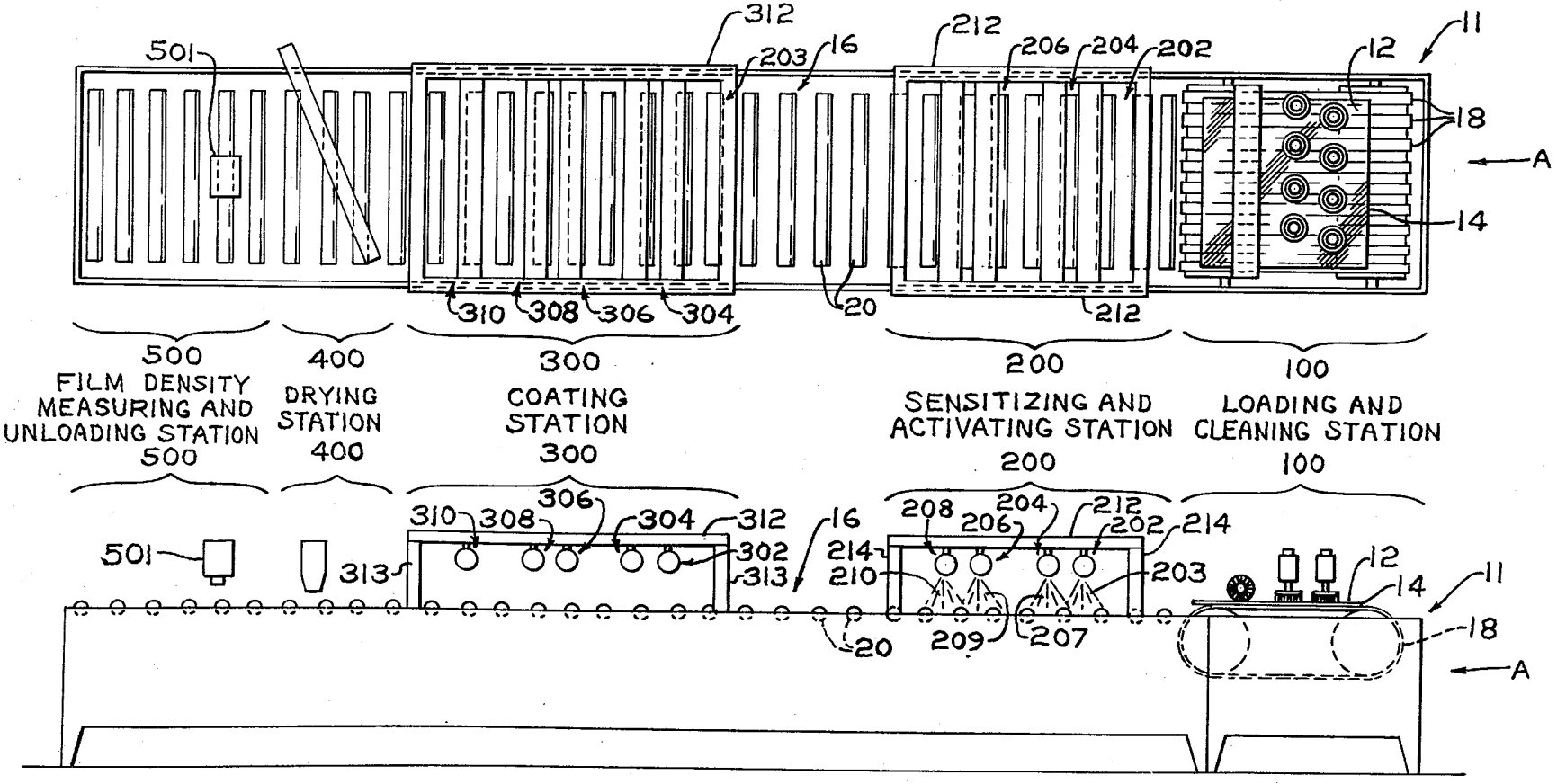
FIG. 1 is a diagrammatic plan view of an apparatus suitable for carrying out the process of the present invention on a continuous basis.
FIG. 2 is a diagrammatic elevation of the apparatus of FIG. 1.

This invention relates to a linear curtain spray applicator. In general, a working fluid medium, e.g. water, sensitizing solution, activating solution or coating solution, is preferably moved under pressure into pressurized streams of a carrier fluid medium, e.g. air, which atomizes the working fluid medium to produce an atomized spray having a generally conical shape. The spray is directed onto a surface of a substrate and has generally equal unidirectional force components at the surface directed away from the spray and lying in a plane generally parallel to the surface. By selectively arranging a plurality of nozzles each emanating an atomized spray, according to the teachings of this invention, across the surface of a substrate, a linear spray curtain is produced across the surface which has generally equal unidirectional force components at each side of the curtain directed away from the curtain and lying in a plane generally parallel to the surface of the substrate. These force components may be used to control the thickness of the working fluid medium on the surface of the article moving into the spray zone.

For purposes of clarity, the linear curtain spray technique of this invention will be described in conjunction with coating apparatus 11 shown in FIGS. 1 and 2 to coat a surface 12 of a piece of glass 14. However, as will be appreciated by those skilled in the art, the invention is not limited thereto. For example, the linear curtain spray technique of this invention may be employed to rinse and/or coat the surface of any substrate. In the discussion, like reference numerals refer to like elements.

With reference to FIGS. 1 and 2, the apparatus 11 generally includes 5 basic stations which are designated for simplicity of discussion as a loading and cleaning station 100, a sensitizing and activating station 200, a coating station 300, a drying station 400, and a film density measuring and unloading station 500. The apparatus 11 also includes a conveyor 16 having a plurality of belts 18 at the loading and cleaning station 100 and rollers 20 at the remaining stations. The belts 18 and rollers 20 are rotated in any conventional manner to move the piece of glass 14 along an article movement path in a direction of the arrow designated by the letter A, i.e., in a downstream direction through the stations.

Loading and Cleaning Station 100

Pieces of glass 14 are successively conveyed through the loading and cleaning station 100 to loosen and remove dirt from the surface 12 of the piece of glass 14 to be subsequently sensitized and activated at the sensitizing and activation station 200 positioned downstream of the loading and cleaning station 100 (see FIGS. 1 and 2). The surface 12 of the piece of glass 14 may be cleaned in any conventional manner such as that taught in U.S. Pat. application Ser. No. 159,746, filed on July 6, 1971, in the name of Helmut Franz, entitled "Angled Cross-fire Rinses", and assigned to PPG Industries, Inc. now U.S. Pat. No. 3,793,054. The description in the above-mentioned U.S. patent application is hereby incorporated by reference.

SENSITIZING AND ACTIVATING STATION 200

After the surface 12 of the piece of glass 14 has been cleaned, it is moved downstream into the sensitizing and activating station 200 where the surface 12 is prepared for subsequent coating in the coating station 300 positioned downstream of the sensitizing and activating station 200.

Figure 3:
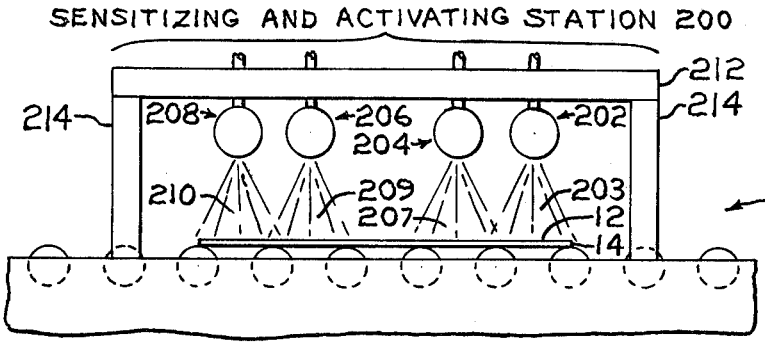
FIG. 3 is a diagrammatic partial elevation of the sensitizing and activating station of the apparatus of FIG. 1 employing the principles of the invention.

With reference to FIGS. 1, 2 and 3, the sensitizing and activating station 200 in general includes (1) a first linear curtain spray rinsing applicator 202 to rinse surface 12 with a rinsing medium, e.g. water, while controlling the thickness of the rinsing medium on the surface of the piece of glass as the piece of glass is conveyed into first rinse zone 203, (2) a linear curtain spray sensitizing applicator 204 positioned downstream of the first rinsing applicator 202 to sensitize the surface with a coating medium, e.g. a dilute solution of stannous chloride, while providing a barrier to prevent the upstream flow of rinsing medium from a second linear curtain spray rinsing applicator 206 positioned downstream of the sensitizing applicator 204 from entering sensitizing zone 207, (3) a second linear curtain spray rinsing applicator 206 to rinse the sensitized surface while controlling the thickness of the rinsing medium on the surface in the second rinse zone 209, and (4) a linear curtain spray activating applicator 208 to activate the surface of the piece of glass with a coating medium, e.g. a dilute solution of palladium chloride, while preventing the rinsing medium from flowing upstream into the activating zone 210.

The spray rinsing applicators 202 and 206, the spray sensitizing applicator 204 and the spray activating applicator 208 are supported in any conventional manner from a pair of rigid members 212 supported by posts 214 such that the applicators 202, 204, 206 and 208 are transverse to, e.g. lying across, the article movement path as shown in FIG. 1. However, as can be appreciated by those skilled in the art, the applicators 202, 204, 206 and 208 may be mounted individually or jointly on a boom for relative movement between the applicators and the piece of glass along the article movement path.

With reference to FIGS. 4 to 11, the discussion will now be directed to the construction of the linear curtain spray applicators that have proven satisfactory. However, as will be appreciated by those skilled in the art, the invention is not limited thereto. The applicators 202, 204, 206 and 208 are similar in construction and the discussion will be directed to the first linear curtain spray rinsing applicator 202 of the sensitizing and activating station 200 with the understanding that the discussion is applicable to applicators 204, 206 and 208 unless stated otherwise.

Figure 4:
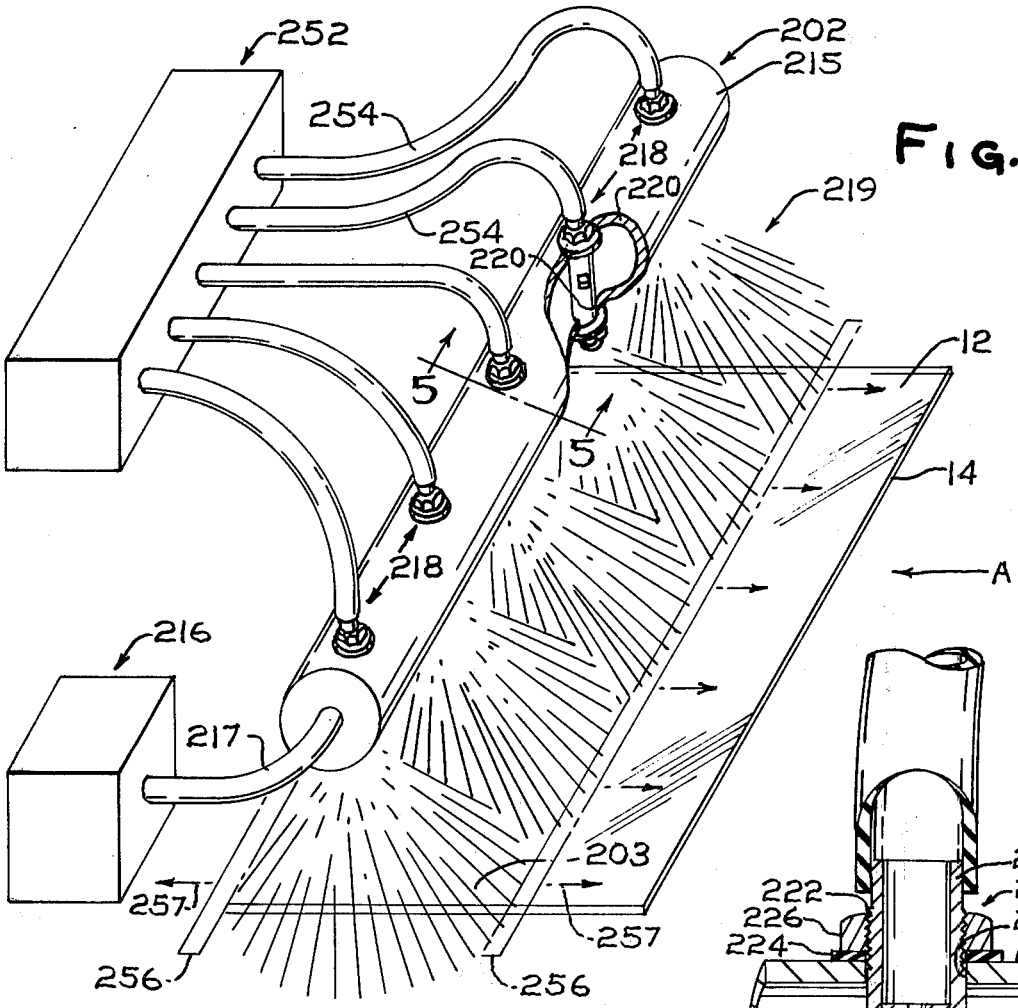
FIG. 4 is an isometric view of a linear curtain spray applicator having portions cut away for purposes of clarity applying a spray having generally upstream and downstream unidirectional forces lying in a plane generally parallel to a surface of an article, according to the teachings of the invention.
Figure 5:
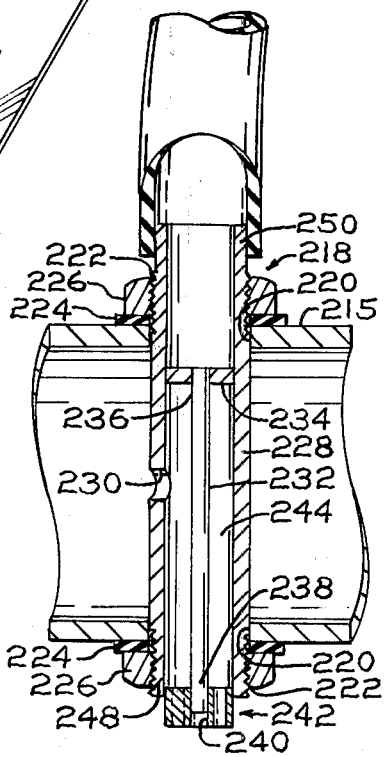
FIG. 5 is a cross-sectional view taken along lines 5—5 of FIG. 4 illustrating the construction of a nozzle embodying the principles of the invention.
Figure 6:
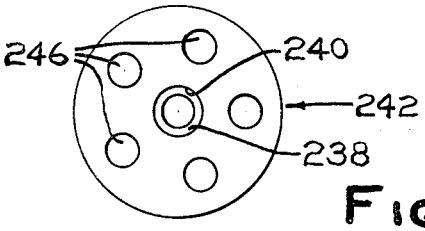
FIG. 6 is a front view of a nozzle tip embodying the principles of this invention.
Figure 8:
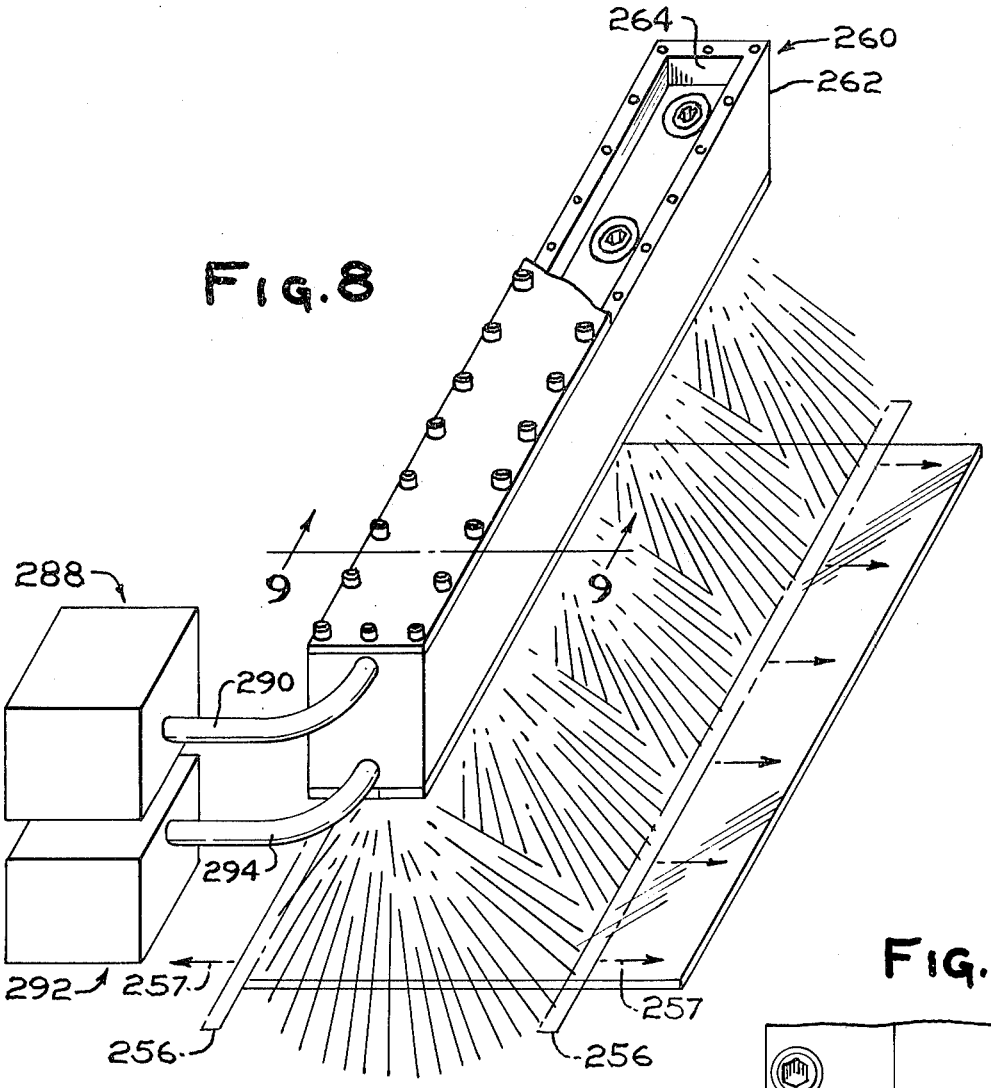
FIG. 8 is an isometric view of an alternate embodiment of a linear curtain spray applicator having portions cut away for purposes of clarity applying a spray having generally upstream and downstream unidirectional forces lying in a plane generally parallel to a surface of an article, according to the teachings of the invention.

Referring specifically to FIGS. 4, 5 and 6, there is shown a conduit 215 having a closed end and connected at the other end to a system 216 which moves a carrier fluid medium under pressure through tubing 217 into the conduit 215. The carrier fluid medium normally used is air but the invention is not limited thereto. For example, the carrier fluid medium may be a gas such as oxygen, nitrogen or argon. The carrier fluid medium is moved through the conduit 215 and through each of a plurality of nozzles 218 to atomize a working fluid medium, e.g. water, sensitizing solution or activating solution, and provide a linear spray curtain 219 in a manner to be fully discussed below.

The nozzles 218 are advantageously mounted through holes 220 formed at selected intervals in the walls of the conduit 215 and hermetically sealed therein to prevent the pressurized carrier fluid medium from escaping through the holes 220 thereby varying the pressure of the carrier fluid medium passing into the nozzles. There are several ways of hermetically sealing the nozzles 218 in the holes 220. One way that has proven satisfactory is illustrated in FIG. 5.

With reference to FIG. 5, the ends of the nozzles 218 are provided with threads 222. A washer 224 made of resilient material is inserted over the ends of the nozzles. A nut 226 is threaded onto each end of the nozzles against the washer 224 to form a hermetic seal. Another way to hermetically seal the nozzles 218 in the holes 220 is to insert rubber grommets into the holes 220 and insert the nozzles 218 into the rubber grommets (not shown).

With continued reference to FIG. 5, the discussion will now be directed to a preferred nozzle construction. Each of the nozzles 218 generally includes an outer tube 228 having a hole 230 formed in a side portion for passing the carrier fluid medium into the nozzle and an inner tube 232 mounted in the outer tube 228 for passing the working fluid medium through the nozzle. A hermetic seal 234 is provided adjacent end 236 of the inner tube 232. The end 238 of the inner tube 232 is hermetically sealed in center hole 240 of a disc 242 (see also FIG. 6). The disc 242 is hermetically sealed in the end of the outer tube 228 to form a carrier fluid medium chamber 244 in the nozzle 218. The hermetic seals at ends 236 and 238 of the inner tube may be formed using a solder if the parts are metal, an organic cement or a non-organic cement.

The disc 242 is provided, in addition to the center hole 240, with a plurality of holes 246 preferably lying in a circle having its center coincident with the center of the hole 240 to move the pressurized carrier fluid medium from the chamber 244 out of the nozzle as a plurality of streams about the working fluid medium moving out of the center hole 240. The disc 242 may be made of any rigid material such as ceramic or metal.

The other end 250 of the nozzle 218 is connected to a system 252 to move the working fluid medium under pressure through tubing 254 to the nozzles 218. The working fluid medium is moved under pressure through the inner tube 232 and out of the center hole 240 of the disc 242 as the carrier fluid medium moves under pressure from the chamber 244 of the nozzles 218 out of the holes 246 to direct an atomized spray of working fluid medium toward the surface 12 of the piece of glass 14.

As shown in FIG. 5, the end 236 of the inner tube 232 is generally flush with the hermetic seal 234. Although not required to practice the invention, it has been found that when the end 236 of the inner tube extends above the hermetic seal 234 as viewed in FIG. 5, a pocket is created which captures the working fluid medium and causes it to become stagnated.

By controlling certain select parameters to be discussed below, the carrier fluid medium atomizes the working fluid medium in the form of the linear spray curtain 219 (see FIG. 4) that has a front 256 about the spray zone 203 having generally equal unidirectional force components 257 along a plane generally parallel to the surface 12 of the piece of glass 14 which acts on the rinsing medium on the surface 12. More particularly, on the right side of the rinse zone 203, as viewed in FIG. 4, the generally equal unidirectional force components 257 move the working fluid medium upstream and on the left side of the rinse zone 203, as viewed in FIG. 4, the generally equal unidirectional force components 257 move the working fluid medium downstream. The front 256 is generally linear and preferably in a straight line. The front 256 preferably extends across the surface 12 of the article 14 and transverse, e.g. lying across the article movement path.

For purposes of clarity, consider the following example. A single nozzle embodying the principles of the invention emanates a generally conical-shaped spray and the spray impinges on the surface of an article generally as a circle. The spray establishes a series of interlapping circular fronts of increasing diameter as the distance from the centroid of the spray increases and having their center axis coincident with the centroid of the spray. These fronts simultaneously generate equal force components in a direction toward and away from the centroid of the spray in a plane generally parallel to the surface of the article. The force of the fronts within the spray cancel each other and the spray does not disturb the rinsing medium in the spray zone. The outermost front has a force that moves any fluid on the surface away from the spray.

By positioning a plurality of nozzles relative to each other such that the ends of adjacent sprays are most nearly at the centroid of adjacent sprays, a pair of generally parallel linear fronts 256 are generated about the spray zone which have equal force components therealong which lie in a plane generally parallel to the surface of the article. The forces acting in an upstream direction, i.e., to the right of the spray, as viewed in FIG. 4, move the fluid medium on the surface away from the spray zone while controlling the thickness of the fluid medium on the surface as the article moves into the spray zone. The forces acting in a downstream direction, i.e., to the left of the spray, as viewed in FIG. 4, move the fluid medium on the surface away from the spray zone to prevent the fluid medium from moving upstream into the spray zone. The interaction of the forces in the spray zone cancel each other thereby preventing the disturbance of the film on the surface in the spray zone.

To achieve the above, it is recommended that the following parameters be considered: (1) the pressure of the carrier fluid medium; (2) the pressure of the working fluid medium; (3) the distance between the outer surface of the disc 242 and the surface 12 of the piece of glass; (4) the ID of the inner tube 232 of the nozzle 218; (5) the cross-sectional area of the holes 246 of the disc 242; (6) the cross-sectional area of the hole 230 formed in the outer tube 228 of the nozzle 218; (7) the distance between the nozzles 218 along the conduit 215; (8) the position of the end 238 of the inner tube 232 in the center hole 240 of the disc 242; (9) the angle of the center axis of the hole 240 of the disc 242 to the surface 12 of the piece of glass 14; (10) the flow of the pressurized carrier fluid medium; (11) the flow of the pressurized working fluid medium; (12) the center-to-center distance between holes 246 and 240 of the disc 242; (13) the center-to-center spacing between the holes 246 of the disc 242; and (14) the number of holes 246 in the disc 242.

Consider now the previously discussed parameters and their operating ranges. As can be appreciated, the invention is not limited thereto but are presented as an illustration. Further, the ranges presented are interrelated for the specified ranges and expanded ranges can be determined therefrom.

(1) As the pressure of the carrier fluid medium increases, the remaining parameters remaining constant, the force of the spray impinging on the surface of the piece of glass increases and coating on the surface may be damaged. Further, increasing the pressure does not provide uniform blending of the working fluid medium in the spray zone. Decreasing the pressure (1) decreases the force components 257 at the fronts 256 of the spray curtain 219 (see FIG. 4) and (2) does not atomize the working fluid medium. An acceptable range has been found to be approximately 1 psi to 50 psi.

(2) As the pressure of the working fluid medium increases, the remaining parameters remaining constant, the injection force into the streams of the carrier fluid medium increases. Too high a pressure does not give full atomization of the working fluid medium. Too low a pressure (1) does not provide sufficient working fluid medium in the spray and (2) the flow rate of the working fluid medium fluctuates from nozzle to nozzle. An acceptable range has been found to be approximately 1 to 50 psi.

(3) As the distance between the outer surface of the disc 242 and the surface 12 of the piece of glass 14 increases, the remaining parameters remaining constant, the force components 257 at the fronts 256 of the spray curtain 219 (see FIG. 4) decreases. An acceptable distance between the outer surface of the disc 242 and the surface 12 is approximately 2 to 12 inches.

(4) As the ID (inside diameter) of the inner tube 232 of the nozzle 218 increases, the remaining parameters kept constant, the flow of the working fluid increases. Too high a flow of the working fluid medium causes the working fluid medium to impinge on the surface as droplets, i.e., the working fluid medium, is not atomized. As the ID of the inner tube 232 decreases, the flow of the working fluid medium decreases. Too low a flow does not provide sufficient working fluid medium on the surface. An ID range of approximately 0.003 to 0.024 inch for the inner tube 232 has been found to be acceptable.

(5) As the cross-sectional area of the holes 246 in the disc 242 (see FIG. 6) decrease, the remaining parameters kept constant, the force of the carrier fluid medium streams decrease and do not atomize the working fluid medium. Further, the force components 257 at the fronts 256 of the spray curtain 219 (see FIG. 4) decrease. It has been found that holes each having a cross-sectional area of approximately 0.000016 to 0.000128 inch are acceptable.

(6) The cross-sectional area of the hole 230 formed in the outer tube 228 of the nozzle 218 (see FIG. 5) should be at least approximately equal to the sum of the cross-sectional area of the holes 246 of the disc 242 (see FIG. 6) to prevent a pressure differential between the chamber 244 of the nozzle and the inside of the conduit 215. It is recommended that the cross-sectional area of the hole 230 formed in the outer tube 228 be larger than the sum of the cross-sectional area of the holes 246 of the disc 242.

(7) As the distance between the nozzles 218 along the conduit 215 increases, the remaining parameters kept constant, the distance between adjacent centroid of sprays increase which does not provide a generally rectangular-shaped spray zone. As can be appreciated, the front 256 (see FIG. 4) would not be along a straight line but the force components 257 at the front 256 decrease as a result of fewer nozzles. Further, the forces instead of being directed away from the spray in the same direction would be directed in different directions where the front deviates from the straight line which could cause streak patterns. It has been found that distances of about ⅛ inch to 2 inches between sprays have proven to be satisfactory.

(8) In general, the end 238 of the inner tube 232 (see FIG. 5) should be flush with the outermost surface of the disc 242 or recessed therein. If the end of the inner tube extends beyond the outermost surface of the disc, the working fluid will impinge on the surface as a stream or droplets and not as an atomized spray. This has been found to be especially true when the end 238 is flat, i.e., lies in a plane generally normal to the center axis of the inner tube. If it is desirable to have the end 238 extend beyond the surface, it is recommended that the end of the tube be in a plane that is oblique to the center of axis of the inner tube (see FIG. 7). In this instance it has been found to be acceptable to have a portion of the end line in the center hole and a portion of the end extend beyond the outer surface.

(9) It is recommended that the angle of the axis of the center hole 240 of the disc 242 (see FIGS. 5 and 6) be along a line normal to the surface of the piece of glass and that the center axis of the hole 240 of the other nozzles lie in a plane so that the forces of the intersecting sprays in the spray zone (1) cancel out, (2) do not disrupt the working fluid medium on the surface of the piece of glass in the spray zone 203 (see FIG. 4) and (3) the force components 257 at the fronts 256 will be equal. Although the invention can be practiced with the center axis other than normal to the surface, best results have been obtained when the center axis of each hole 240 of each nozzle lie in a plane normal to the surface of the piece of glass.

(10) As the flow of the pressurized carrier fluid medium decreases, the remaining parameters kept constant, the working fluid medium will not be atomized and the force components 257 at the fronts 256 (see FIG. 4) decrease. As the flow of the carrier fluid medium increases, the uniformity of the working fluid medium on the surface is disturbed by turbulence. It has been found that flow rates of approximately 0.5 to 2.5 SCFM (standard cubic foot per minute) per nozzle are acceptable.

(11) As the flow of the pressurized working fluid medium increases, the remaining parameters kept constant, the working fluid medium will not be atomized. This causes puddling on the plate and an uncontrolled flow pattern. Too low a flow will not provide sufficient working fluid medium on the plate. A flow rate of approximately 1 cc/min. to 50 cc/min. has been found to be acceptable.

(12) As the center-to-center distance of the holes 246 and hole 240 increase, the remaining parameters kept constant, there will be less interaction between the carrier fluid medium and working fluid medium and as a result, there is (1) no atomization of the working fluid medium and (2) uneven distribution of the working fluid medium. The center-to-center spacing of the holes 246 and 240 should be as close as physically or mechanically possible and preferably no farther apart than approximately 0.1 inch.

(13) If the center-to-center spacing between the holes 246 of the disc 242 are not equal, the remaining parameters kept constant, the forces within the spray and the force components 257 at the fronts 256 (see FIG. 4) will not be equal. Although the invention can be practiced when the center-to-center spacing between holes 246 are not equal, it is preferred that they be equal.

(14) As the number of holes 246 in the disc decrease, the remaining parameters kept constant, the cross-sectional area of the spray zone decreases. Satisfactory results have been obtained when the end 238 of the inner tube 232 (see FIG. 5) is inserted in a hole and the outer wall of end 238 of the inner tube 232 is spaced from the wall of the hole to move the carrier fluid medium through the hole. Therefore, the number of holes for passing streams of carrier fluid medium is not a limiting factor in practicing the invention.

As can be appreciated by those skilled in the art, the invention is not limited to a particular nozzle arrangement. Other arrangements can be utilized to practice the method of this invention. More particularly, and with reference to FIGS. 8 to 11, there is shown an alternate embodiment of a linear curtain spray applicator 260. With specific reference to FIGS. 8 and 9, the linear spray applicator 260 includes an intermediate member 262 having an upper trough 264 and a lower trough 266 (shown better in FIG. 9) interconnected at selected intervals by passageways 268 having a larger ID (inside diameter) near the upper trough 264 and a smaller ID near the lower trough 266 to form a ledge 270 for receiving a washer 272 (shown better in FIG. 9).

Figure 9:
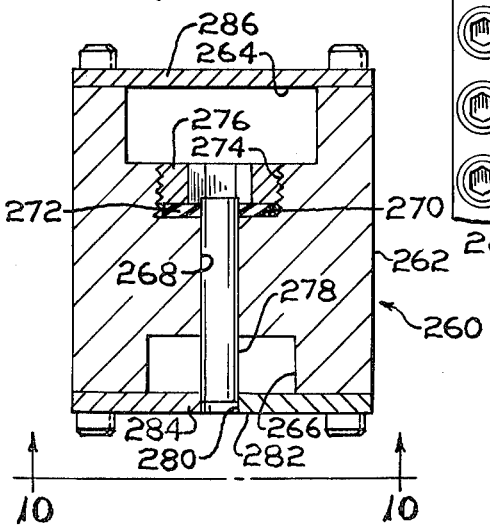
FIG. 9 is a cross-sectional view taken along lines 9—9 of FIG. 8.

The upper portion of passageways 268, as viewed in FIG. 9, are provided with threads 274 for receiving an outward threaded nut 276. A tube 278 similar to the inner tube 232 of the nozzle 218 (see FIG. 5) is positioned in each passageway 268 and has one end extending beyond the ledge 270 and the other end in holes 280 formed by plates 282 and 284 mounted to the bottom of the member 262 over the lower trough 264 as shown in FIG. 9. The washer 272 is positioned about the upper end of the tube 278 and the nut 276 threaded about the end of the tube adjacent to the washer to form a hermetic seal between the upper and lower troughs 264 and 266, respectively.

A plate 286 is securely mounted over the upper trough 264 and the working fluid medium is moved under pressure into the upper trough from a system 288 similar to the system 252 as shown in FIG. 4 through tubing 290 advantageously connected to the upper trough 264. The working fluid medium passes through the tube 278 and out of the bottom of the applicator 260 toward the surface 12 of the piece of glass 14.

Figure 11:
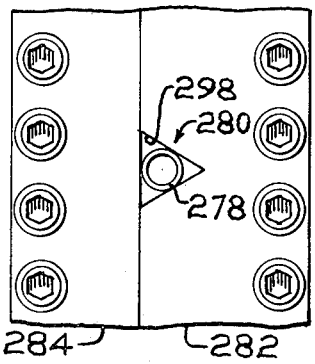
FIG. 11 is a view similar to FIG. 10 illustrating an alternate embodiment for centrally locating the tube.
Figure 10:
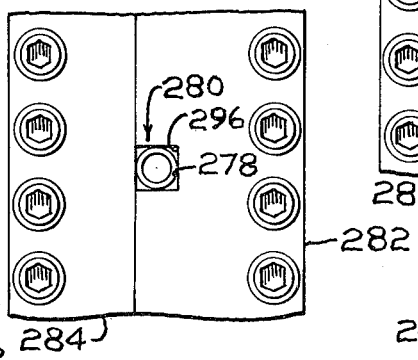
FIG. 10 is a sectional view seen along lines 10—10 of FIG. 9 illustrating an embodiment of a hole configuration to centrally locate a tube of the linear curtain spray applicator of this invention.
Figure 7:
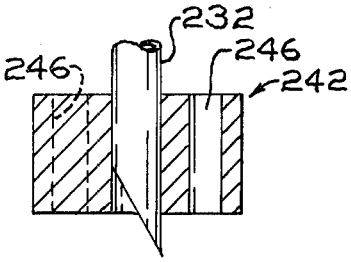
FIG. 7 is a cross-sectional side view of an alternative embodiment of a nozzle tip.

With reference to FIGS. 10 and 11, holes 280 are formed by the plates 282 and 284 and have a geometric configuration, e.g. a circle, a square or a triangle. This may be accomplished by providing plate 284 with a straight edge and plate 282 with spaced holes. The plates 282 and 284 are mounted over the bottom trough 266 and a pressurized carrier fluid medium from system 292 similar to system 216 shown in FIG. 4 is moved into the lower trough 266 by way of tubing 294 and out of the holes 280 to atomize the working fluid medium passing out of the tube 278.

As shown in FIG. 10, the hole 280 may be a square 296 having each side tangent to the outside wall of the tube 278. In FIG. 11, the hole 280 may be an equilateral triangle 298 having each side tangent to the outer wall of the tube. In this manner the tube is centered in relationship to the pressurized carrier fluid medium moving out of the lower trough through the holes.

Preferably the end of the tube is generally flat, i.e., lies in a plane normal to the center axis of the tube. The end is preferably flush with the outer surface of the plates 282 and 284 or recessed therein about 0.003 inch. It has been found that when the end of the tube 278 is flat and extends beyond the outer surface of the plates, the working fluid medium is not atomized but forms droplets. If the end of the tube is recessed in too far, the working fluid medium is partially atomized but does not give the desired linear spray curtain.

In certain instances, it may be desirable to have the end of the tube 278 extend beyond the outer surface of the plates 282 and 284. In those instances, it is recommended that the end of the tube be provided with a wedge shape, i.e., the end of the tube lies in a plane at an oblique angle to the center axis of the tube (see FIG. 7). In this instance, a portion of the tip may be in the hole 280 and a portion of the tip extends beyond the plates 282 and 284.

Referring back to FIG. 3, the discussion will now be directed to the piece of glass 14 as it passes through the sensitizing and activating station 200.

The first linear curtain spray rinsing applicator 202 rinses the surface 12 of the piece of glass as it moves into the station 200 to remove any undesirable material carried over from the loading and cleaning station 100 (see FIG. 1). The first rinsing applicator 202 rinses the surface while controlling the thickness of the rinsing medium on the surface. The thickness of the rinsing medium on the surface is controlled by the force components 257 at the upstream front 256 of the first rinse zone 203 that moves the rinsing medium in excess of a desired uniform thickness upstream of the zone 203.

The atomized rinsing medium impinging on the surface does not disrupt the uniform film because the forces in spray cancel out as previously discussed.

After the surface 12 is rinsed, it moves into the sensitizing zone 207 of the linear curtain spray sensitizing applicator 204 where the rinsed surface of the piece of glass is sensitized. The sensitizing applicator 204 and the first rinse applicator 202 may be positioned relative to one another so that the spray of the first rinse applicator 202 and the spray of the sensitizing applicator 204 are spaced apart or intersect one another at the surface of the piece of glass.

When the spray of the first rinse applicator 202 and the spray of the sensitizing applicator do not intercept at the surface of the piece of glass, the following is believed to occur. The force components of the downstream spray front 256 of the first rinse applicator 204 moves the rinsing medium toward the spray zone 207 of the sensitizing applicator 204. The upstream forces at the sensitizing zone 207 of the sensitizing applicator 204 control the rinsing medium thickness as the rinsed surface moves into the sensitizing zone 207. The rinsing medium and some sensitizing solution is contained between the upstream front of the sensitizing spray and the downstream front of the first rinse applicator 202. The rinsing medium and sensitizing solution is then either (1) moved over the side or (2) the trailing edge of the piece of glass as the trailing edge moves out of the rinse zone 203. In the prior art, more particularly angled crossfire rinses, the spray of the crossfire rinses and the spray of the coating spray were positioned to intercept from about $\frac{1}{8}$ inch to $\frac{1}{4}$ inch at the surface of the glass to prevent puddling. The linear curtain spray applicator of this invention obviates the need for precision adjustment to intersect the rinse and coating sprays. This is because if the spray of the first rinse applicator does not intercept the spray of the sensitizing applicator, the frontal upstream forces of the sensitizing applicator controls the thickness of the rinse medium.

When the spray of the sensitizing and first rinse applicators touch or intercept at the surface of the piece of glass from about greater than zero inch to $\frac{1}{4}$ inch, the upstream forces of the sensitizing applicator and the downstream forces of the first rinse applicator cancel out. The rinse medium film moving into the sensitizing zone has a uniform thickness and the atomized spray of the sensitizing applicator impinges on the rinse medium and diffuses therethrough to sensitize the surface of the piece of glass. When the sprays intercept more than $\frac{1}{4}$ inch, the downstream forces of the rinse medium disturb the rinse medium film in the sensitizing zone. This makes the rinse medium film non-uniform which results in a non-uniform sensitized surface.

Although not necessary to practice the invention, it is recommended that the spray of the rinse applicator intercept the spray of the sensitizing applicator so that the surface of the glass will be sensitized in the sensitizing zone 207 and not between the sensitizing zone 207 and spray zone 203.

The article having the sensitized surface is further conveyed toward the second linear curtain spray rinsing applicator 206 to rinse the sensitized surface. The distance between the sensitizing applicator 204 and the second rinse applicator 206 and the speed of the piece of glass along the article movement path is selected to provide sufficient time for the sensitizing solution to sensitize the surface 12.

As the leading edge of the piece of glass moves downstream of the sensitizing applicator 204, the downstream force components of the sensitizing applicator spray move the sensitizing solution downstream toward the leading edge of the piece of glass. When the leading edge of the piece of glass moves into the spray zone of the second rinse applicator 206, the upstream force components of the second rinsing applicator spray move the rinse medium mixed with the sensitizing solution toward the sensitizing spray but is prevented from moving under the sensitizing spray by the downstream forces of the sensitizing applicator.

When the trailing edge passes out of the sensitizing spray, the upstream force components of the second rinse applicator tend to move the rinse medium mixed with the sensitizing solution over the trailing edge of the piece of glass.

The discussion of the sensitizing spray applicator 204 and first rinse applicator 202 is applicable to the second rinse applicator 206 and the activating applicator 208 in regards to providing a uniform film of rinse medium on the surface of the article prior to being activated (or super sensitized). The piece of glass incrementally moves out of the activating spray zone and toward the coating station 300.

The distance between the sensitizing and activating station 200 and the coating station 300 and the speed of the piece of glass along the article movement path is selected so that the activating solution has sufficient time to activate the sensitized surface 12 of the piece of glass before it is coated.

Coating Station 300

Referring to FIG. 12, there is shown the coating station 300. For the sake of illustration and discussion, the coating station has a first linear curtain spray rinsing applicator 302, a first linear curtain spray coating applicator 304, a second linear curtain spray rinsing applicator 306, a second linear spray coating applicator 308, and a third linear curtain spray rinsing applicator 310. Each of the applicators is advantageously mounted on a frame 312 supported by posts 313 such that the applicators are transverse, i.e., lie across the article movement path. The first, second and third rinsing applicators 302, 306 and 310, respectively, are similar to the first and second rinsing applicators 202 and 206, respectively, of the sensitizing and activating station 200.

The coating solution normally used to coat a transparent metal coating on the surface of the article is a combination of a metal solution and a reducing solution, therefore, the first and second coating applicators 304 and 308, respectively, differ slightly from either the sensitizing and activating applicators 204 and 208, respectively. These differences will now be discussed.

With reference to FIG. 13, a Y-shaped tubing 315 is mounted on the end of the nozzles 218. One leg 316 of the Y-shaped tubing 315 is connected to a system (not shown) for moving the reducing solution under pressure to the nozzle 218 similar to the system 252 (see FIG. 4). The other leg 317 of the Y tubing is connected to a system (not shown) for moving the metal solution under pressure to the nozzle 218 likewise similar to the system 252 (see FIG. 4). The metal solution and reducing solution mix in the third leg 318 of the tubing. The mixed solutions pass through the inner tube 232 of the nozzle 218 as pressurized carrier fluid medium is moved through the conduit 215 and out of holes 246 (see FIG. 5) in like manner as previously discussed to atomize the sensitizing or activating coating solutions and provide a front 319 having force components 320 upstream and downstream of the coating zone 322.

Another expediency to coat the surface of the piece of glass is to move the metal solution through every other nozzle 218 and the reducing solution through the remaining nozzles. As previously discussed, the spray of the nozzles overlap and the reducing solution reacts with the coating solution at the surface to coat the surface in the coating zone 322.

With reference to FIG. 14, there is shown still another embodiment of a coating applicator. The coating applicator 325 is identical to the linear curtain spray applicator 260 of FIG. 8 with the exception that a baffle 326 is provided in the upper trough 264 to connect every other passageway 268. The metal solution is moved from a system 328 similar to system 288 into the upper trough 264 by way of tubing 330 and passes through alternative passageways. The reducing solution is moved under pressure from system 322, similar to system 288 into the upper trough 264 and guided by the baffle into the remaining passageways. The metal solution spray and the reducing spray intermix at the surface of the piece of glass to coat the surface.

Figure 15:
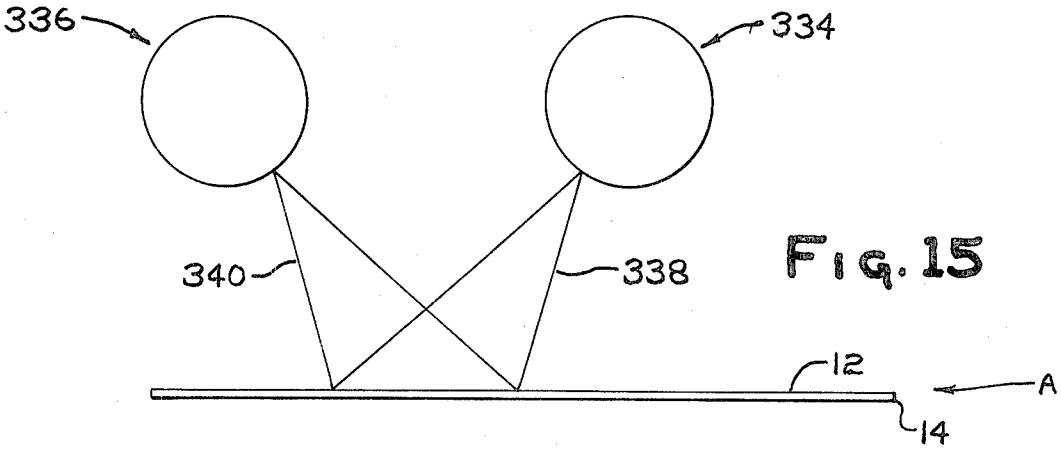
FIG. 15 is a side view of a pair of linear curtain spray applicators embodying the principles of this invention for mixing a metal solution and a reducing solution at the surface of an article.

As can be appreciated, if a premixed stabilized coating solution of a metal solution and a reducing solution is used, then the coating applicators 304 and 306 would be similar to the rinse applicators 202 of FIG. 4. With reference to FIG. 15, there is shown still another method of coating the surface of the piece of glass. In this instance a pair of linear curtain spray applicators 334 and 336 are mounted such that curtain spray 338 of a metal solution from the applicator 334 overlap curtain spray 340 of a reducing solution from the applicator 336 at the surface 12 of the piece of glass 14.

It will be noted that the changes discussed were directed to react the metal solution with reducing solution to coat the piece of glass. The nozzle arrangement and parameters discussed in the section entitled "Sensitizing and Activating Station 200" are applicable to the rinse applicators 302, 306 and 310 and coating applicators 304 and 308.

With reference now to FIG. 12, as the piece of glass is moved along the rollers 20 under the first rrinse applicator 302 of the coating station, the upstream forces move the rinse medium mixed with activating solution upstream. If the trailing edge of the piece of glass is downstream of the spray of activating applicator 208 (see FIG. 3), the rinse medium is moved either over the trailing edge or sides of the piece of glass. If the trailing edge of the piece of glass is under the spray of the activating applicator 208, the downstream forces of the activating spray prevent the rinsing medium from moving into the activating zone 210 (see FIG. 3).

The first coating applicator 304 is positioned relative to the first rinse applicator 302 of the coating station such that the upstream force components of the coating spray 342 and the downstream force components of the rinsing spray 344 are spaced from each other or intersect, i.e., the coating spray intersects the first rinsing spray. If the sprays are spaced apart at the surface of the piece of glass, the upstream force components of the coating spray control the rinsing medium film as previously discussed. If the rinsing spray and the coating spray intersect, the rinsing medium film thickness is controlled by the upstream force components of the first rinse applicator as previously discussed for the first rinsing applicator 202 and sensitizing applicator 204 of the sensitizing and activating station 200.

After the first coating is applied to the surface of the piece of glass, the surface is rinsed prior to applying a second coating. As the article moves toward the second rinsing applicator 306, the downstream forces of the first coating applicator moves the rinsing medium mixed with coating solution toward the leading edge of the piece of glass. As the leading edge passes into the spray of the second rinse applicator, the upstream force components of the second rinse spray 346 moves the rinsing medium generally upstream while controlling the rinsing medium film thickness to provide a uniform thickness of rinsing medium film.

If the trailing edge has passed under the first coating spray 342, the upstream force components of second rinsing spray 346 move the rinsing medium having coating solution over the trailing edge of the piece of glass. If the trailing edge of the piece of glass is under the first coating spray 342, the downstream force components prevent the rinsing medium from moving under the first coating spray 342.

The distance between the first coating applicator 304 and the second rinse applicator 306 and the speed of the piece of glass is selected to allow the coating solution to react and coat the rinsed activated surface.

The piece of glass is further conveyed through the spray 346 of the second rinse applicator and the spray 348 of the second coating applicator 308. The discussion directed to the piece of glass moving under the first rinse applicator 302 and the first coating applicator 304 is applicable to the piece of glass moving through the spray 346 of the second rinse applicator 306, the spray 348 of the second coating applicator 308 and the spray 350 of the third rinse applicator 310.

Afterwards, the piece of glass having the coated surface is conveyed from the coating station 300 into the drying station 400.

Drying Station 400

The piece of glass having the rinsed coated surface is conveyed on the rollers 20 from the coating station 300 into the drying station 400 (see FIG. 1) to dry the surface. The surface may be dried in any conventional manner such as that taught in the above-mentioned U.S. Pat. No. 3,793,054.

Film Density Measuring and Unloading Station 500

After the surface of the piece of glass is dried, it is conveyed into the film density measuring and unloading station 500 (see FIG. 1) where the transmittance and reflectance of the deposited film on the surface of the piece of glass is measured by an instrument 501 in any conventional manner.

Although the discussion was directed to linear curtain spray applicators using nozzles, the invention is not limited thereto. With reference to FIGS. 16 and 17, there is shown another type of a linear spray curtain applicator 360 that may be used to practice the method of this invention.

The applicator 360 has a pair of center members 362 urged together about a preforated member 364 by way of bolts 366. A trough 368 is formed by the members 362 at the top of the applicator as viewed in FIGS. 16 and 17. A plate 370 is advantageously mounted over the trough and the working fluid medium is moved into the trough 368 by way of tubing 372 as previously discussed.

The working fluid medium moves under pressure along the perforated member 364 toward the bottom edge of the applicator 360 as viewed in FIGS. 16 and 17.

Figure 18:
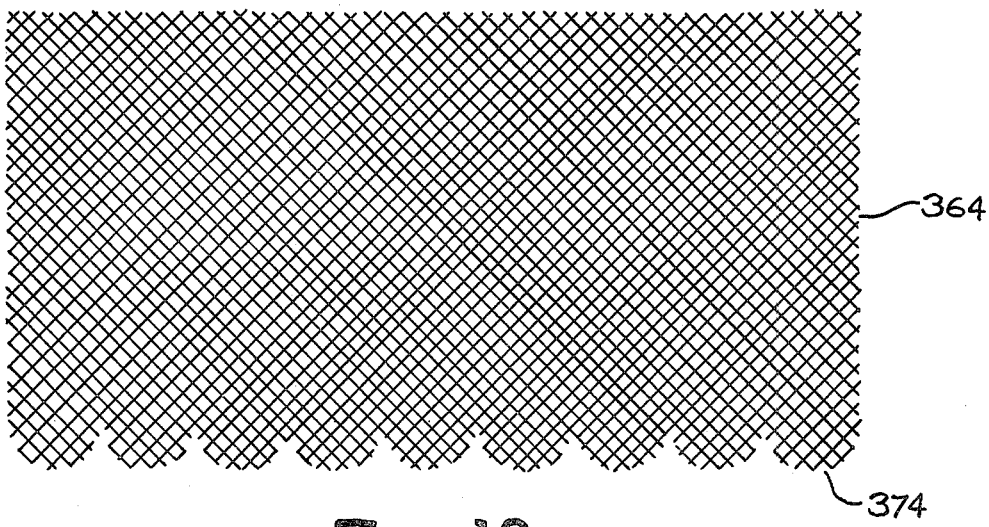
FIG. 18 is a front view of an element of the linear curtain spray applicator of FIG. 16 to move a working fluid medium from one side of the applicator of FIG. 16 to an opposite side into streams of pressurized carrier fluid medium.

As shown in FIG. 18, the member 364 has a scalloped edge 374, e.g. a series of semicircular or angled tips which partially extend beyond the bottom edge of the members 362.

A plate 376 is mounted on each of the members 362 as shown in FIG. 17 about the end 374 of the member 364. The pressurized carrier fluid medium is moved into the applicator 360 by way of tubing 378 and is moved through passageways 380 about the end 374 of the perforated member 364 to atomize the working fluid medium.

Figure 19:
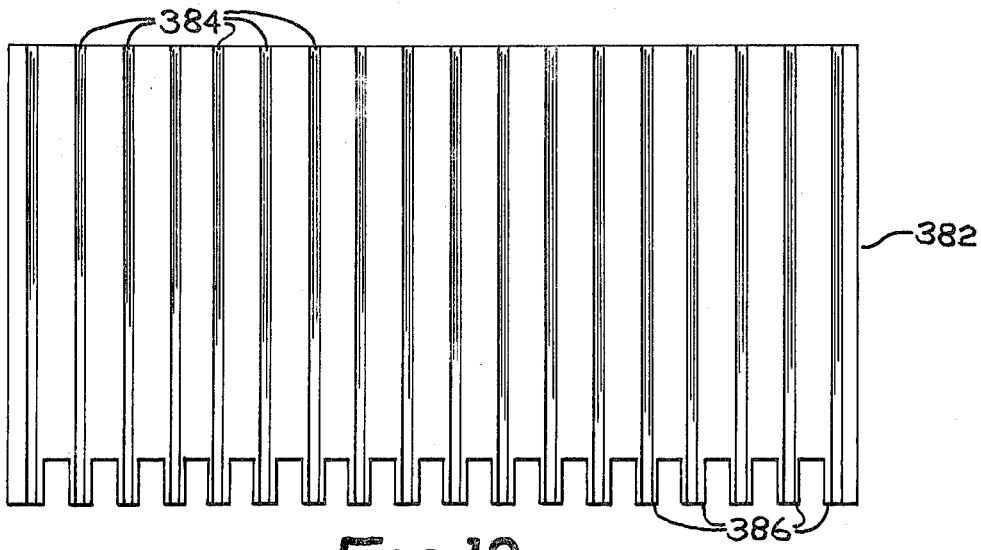
FIG. 19 is a front view of another embodiment of the element of the linear spray applicator of FIG. 16 to move the working fluid medium into streams of pressurized carrier fluid medium.

With reference to FIG. 19, the perforated member 364 may be replaced with a plate 382 having a plurality of grooves 384 on each surface extending from one side of the plate to each of a plurality of fingers 386 at the opposite side.

As can now be appreciated by those skilled in the art, the design of the linear curtain spray applicator is not intended to limit the method of the invention.

Detailed Description of the Invention

The invention will now be discussed to coat a surface 12 of a 40 inch by 40 inch by ¼ inch piece of soda-lime-silica glass 14 with a transparent film of nickel boron.

A representative range of composition for soda-lime-silica glass may be found in the above-mentioned U.S. Pat. No. 3,793,054. A tin solution is used in the illustration to sensitize the surface of the piece of glass; a palladium solution is used in the illustration to activate the sensitized surface of the article. The coating solution used in the illustration includes a nickel solution and a reducing solution. The constituents and their respective amounts to make up the tin solution, palladium solution, nickel solution and reducing solution may be found in the above-mentioned U.S. Patent.

With reference to FIGS. 1 and 2, the loading and cleaning station 100, the drying station 400 and the film density measuring and unloading station 500 are as described in the above-mentioned U.S. Pat. No. 3,793,054.

With reference to FIG. 3, the sensitizing and activating station 200 is provided with first and second linear curtain spray rinsing applicators 202 and 206, respectively; a linear curtain spray sensitizing applicator 204 and a linear curtain spray activating applicator 208. Each of the applicators is advantageously mounted on rigid members 212 such that the applicators are transverse, e.g. lying across the article movement path as designated by the letter A.

The first rinsing applicator 202 and the sensitizing applicator 204 are on a center-to-center spacing of approximately 2 inches so that the spray zones 203 and 207 of the rinsing and sensitizing applicators, respectively, intersect at about ⅛ inch. In other words, the spray of the first rinsing applicator intersects the spray of the sensitizing applicator about ⅛ inch at the surface of the piece of glass. The sensitizing applicator 204 and the second rinsing applicator 206 are on a center-to-center spacing of approximately 3 feet so that the sensitizing solution has sufficient time to react with surface 12 of the piece of glass before it is rinsed from the surface. The second rinse applicator 206 and the activating applicator 208 are on a center-to-center spacing of approximately 2 inches so that the spray zones 209 and 210, respectively, intersect at about ⅛ inch at the surface of the glass.

Referring now to FIG. 12, the coating station 300 is provided with a first, second and third linear curtain spray rinsing applicators 302, 306 and 310, respectively; and a first and second linear curtain spray coating applicators 304 and 308, respectively. Each of the applicators is advantageously mounted on frame 312 such that the applicators are transverse, e.g. lying across the article movement path as designated by the letter A.

The first rinsing applicator 302 and the activating applicator 208 are on a center-to-center spacing of about 3 feet so that the activating solution has sufficient time to activate the sensitized surface before the activating solution is rinsed from the surface. The first coating applicator 304 is spaced from the first rinsing applicator 302 approximately 2 inches so that the sprays of the first rinsing applicator and first coating applicator intersect at the surface of the glass at about ⅛ inch. The second rinse applicator 306 and the first coating applicator 304 are on a center-to-center spacing of about 6 feet so that the coating solution has sufficient time to coat the surface of the piece of glass before the coating solution is rinsed off. The second rinsing applicator 306 and the second coating applicator 308 are on a center-to-center spacing of 2 inches so that the sprays of the second coating applicator and second rinsing applicator intersect at the surface of the glass about ⅛ inch. The second coating applicator 308 and the third rinsing applicator 310 are on a center-to-center spacing of about 6 feet so that the coating solution has sufficient time to coat the surface of the glass before it is rinsed from the surface.

In the above discussion, selected ones of the sprays intersect at the surface. However, as was previously discussed, the invention is not limited thereto and the sprays need not intersect.

The nozzle arrangements of this invention are similar for each of the applicators in sensitizing and activating station 200 and the coating station 300. Therefore, the discussion will be directed to the first rinsing applicator 202 of the sensitizing and activating station 200 and the discussion will be applicable to each of the applicators at stations 200 and 300.

With reference to FIG. 5, each nozzle 218 includes an outer tube 228 having an ID of ⅛ inch; a wall thickness of 0.025 inch and a length of 2 inches. A disc 242, 0.078 inch in diameter and ½ inch in length, is mounted in the bottom end of the tube 228 as shown in FIG. 5 with epoxy such as E-POX E manufactured by Duroplastics to hermetically seal the disc 242 in the bottom end of the tube 228. With reference to FIG. 6, the disc is provided with 5 holes 246 having their center lying in a circle having a diameter of 0.024 inch. The center axis of the circle is coincident with the center of center hole 240. The diameter of the holes 246 and 240 is 0.016 inch. The center-to-center spacing of each hole 246 is 72°.

Referring back to FIG. 5, an inner tube 232 has an ID of 0.008 inch; a wall thickness of 0.004 inch and a length of 2 inches. End 238 of the inner tube 232 is hermetically sealed as by epoxy in the center hole 240 and recessed therein from the outer surface of the disc 242. The other end 236 of the inner tube 232 is hermetically sealed in the outer tube 228 by epoxy or solder, if applicable, to form a chamber 224 in the outer tube 228. A hole 230 having a cross-sectional area of 0.0005 square inch is formed in the outer tube 228 to provide access to the chamber 244.

With reference to FIG. 4, a plurality of nozzles 218 are mounted at spaced intervals through holes 220 found in a conduit 215 45 inches in length such that the center axis of the center hole 240 of the disc 242 (see FIG. 6) is normal to the article movement path, i.e., normal to the surface of the piece of glass. The distance between the outer surface of the disc 242 and the article movement path is approximately 4 inches.

The nozzles are hermetically sealed in the conduit 215 by providing threads 222 along portions of opposite ends of the outer tube 228 which extend beyond the conduit 215. A washer 224 made of rubber is inserted over each end of the outer tube and a bolt threaded on each end to compress the washer 224 to form a hermetic seal. The hermetic sealing of the nozzles 218 in the conduit 215 is recommended to eliminate variations in pressure of the carrier medium. If desired to further insure hermetic sealing of the nozzles in the conduit, teflon tape may be applied to the threads 222 before threading on the nut.

The nozzles are on a center-to-center spacing of ½ inch along the conduit 215 so that the spray of each nozzle is at the centroid of adjacent sprays at the surfaces of the piece of glass.

It is preferred that the center-to-center distance of the outermost nozzles on the conduit be approximately 40 inches which is the edge-to-edge spacing of the piece of glass. With this arrangement, the intersecting of sprays at the surface provide a linear curtain across the surface of the piece of glass having a uniform force component 257 at the front 256, i.e., upstream force components on the right side of the spray 219 and downstream force components at the left side of the spray 219, as viewed in FIG. 4.

The working fluid medium, e.g. rinse water, the sensitizing solution, the activating solution, the metal solution or the reducing solution, is moved under a pressure of 40 psi and a flow rate of 15 cc/min. through the inner tube 232 and out of the center hole 240 of the disc 242. Simultaneously the carrier fluid medium, e.g. air, is moved under a pressure of 20 psi and a flow rate of 1.5 SCFM through holes 246 of the disc 242 to atomize the working fluid medium. The system 252 for moving the working fluid medium under pressure may be any conventional pump. The carrier fluid medium is moved under pressure using the system 216 such as a compressor.

Referring now to FIG. 13, the first and second coating applicators 304 and 308, respectively, have a leg 318 of a Y-shaped tubing 315 connected to each of the nozzles. Leg 316 of each of the Y-shaped tubing is connected to a system similar to the system 252 of the rinse applicator to move the nickel solution to the nozzles. Leg 317 of each of the Y-shaped tubing is connected to a system similar to the system 252 of the rinse applicator to move the reducing solution to the nozzles. The nickel solution and reducing solution mix as the solutions are moved under pressure through the inner tube 232, and the hole 240 of the disc 242. Air is simultaneously moved out of holes 246 of the disc 242 under a pressure to atomize the coating solution.

Pieces of glass 14 are successively loaded at the loading and cleaning station 100 of the apparatus 10 (see FIGS. 1 and 2). The surface 12 of the piece of glass is cleaned in a manner described in the above-mentioned U.S. Pat. No. 3,793,054.

After the surface is cleaned, it is conveyed along rollers 20 which are rotated to move the piece of glass at 3 feet per minute through stations 200, 300, 400 and 500. As the leading edge of the piece of glass enters the upstream side of the spray of the first rinse applicator 202, the upstream force components of the spray move water in excess of a thickness of about 0.03 inch upstream. The rinsing medium film on the surface of the piece of glass is uniform from side to side as it is further conveyed into the rinse spray. Since the downstream force components of the rinse spray and the upstream force components of the sensitizing spray intersect at the surface of the piece of glass cancelling each other out, the rinse medium on the surface is undisturbed and remains uniform.

As the surface passes through the sensitizing spray, the tin solution is sprayed on the surface of the rinsing medium and diffuses therethrough to the surface of the glass. Since the concentration of the tin solution is uniformly atomized in the spray and the film of rinse water is uniform, the surface of the piece of glass is uniformly sensitized.

When the leading edge of the piece of glass passes out of the sensitizing spray, the frontal forces on the downstream side of the sensitizing spray prevent any rinsing medium from moving upstream into the sensitizing spray thereby maintaining the film of rinsing medium on the surface of the piece of glass under the sensitizing spray uniform.

Continued conveying of the piece of glass moves the leading edge into the second rinse set 206. The frontal forces at the upstream side of the second rinsing spray urge the rinsing medium mixed with sensitizing solution toward the sensitizing spray to provide the surface of the piece of glass moving into the second rinsing spray applicator with a rinsed surface having a uniform film of rinsing medium on the surface. The rinsing medium having sensitizing solution is prevented from entering into the spray zone of the sensitizing applicator by the force components on the downstream side of the sensitizing spray.

The piece of glass moves through the spray of the second rinse set and the spray of the activating set where the sensitized surface is activated by the palladium solution. The surface of the glass as it moves out of the activating applicator is uniformly activated for the same reason discussed above, e.g. (1) a uniform film of rinse water on the surface of the glass, (2) the palladium solution uniformly atomized in the spray and (3) the atomized spray does not cause turbulence of the rinsing medium film during activating.

The piece of glass is conveyed downstream by rollers 20 out of the sensitizing and activating station 200 and into the coating station 300. As the leading edge of the piece of glass moves under the first rinsing applicator 302, the surface is rinsed. Excess rinsing medium mixed with activating solution is moved upstream along the surface by the upstream force components on the upstream side of the spray of the first rinsing applicator 302 to rinse the activated surface of the piece of glass and provide the surface with a uniform rinsing medium thickness film of 0.03 inch. The excess rinsing medium mixed with spent activating solution is prevented from moving under the activating spray by the downstream force components on the downstream side of the activating spray. The activated surface of the piece of glass as it passes through the sprays of the first rinsing applicator 302 and the first coating applicator 304 has a transparent coating of nickel boron which is uniform across the surface for reasons previously discussed, e.g. (1) a uniform film of rinse medium on the surface of the glass, (2) the coating solution uniformly atomized in the spray and (3) the rinsing medium film on the surface during coating is not disturbed.

The piece of glass is further conveyed toward the second rinsing applicator 306. As the leading edge of the piece of glass moves into the second rinsing spray, the force components on the upstream side of the second rinsing spray move excess rinsing medium mixed with coating solution generally upstream along the surface of the piece of glass so that the coated surface is rinsed and has a uniform film of rinsing medium about 0.03 inch thick. The excess rinsing medium is prevented from moving under the second coating spray by the frontal forces on the downstream side of the second coating spray. The coated surface of the piece of glass as it moves out of the second coating spray has a uniform transparent coating of nickel boron for reasons previously discussed, e.g. (1) a uniform film of rinsing medium on the surface during coating, (2) the coating solution is uniformly atomized in the spray and (3) the rinsing medium on the surface during coating is undisturbed.

The piece of glass is conveyed out of the second coating spray toward the third rinsing spray of the third rinsing applicator 310. As the leading edge passes under the third rinse spray, the surface is rinsed. The force components on the upstream side of the third rinse spray move rinsing medium mixed with coating solution toward the second coating spray but are prevented from moving thereunder by the force components on the downstream side of the second coating spray.

Although the third rinse spray controls the rinsing medium to provide a uniform film of water on the surface, it is of no consequence because the piece of glass is subsequently moved into the drying station.

The coated surface of the piece of glass is dried at the drying station 400 in a manner fully described in U.S. Pat. No. 3,793,054.

Thereafter the piece of glass is conveyed into the film density measuring the unloading station 500 where the transmittance and reflectance of the coating is measured. The piece of glass having the coated surface is removed from station 500 for subsequent processing.

Although the invention was discussed for coating a piece of glass using a specific process and apparatus, the invention is not limited thereto. The linear curtain spray applicator of this invention can be used individually or in a group to coat and/or rinse a surface of any substrate. Further, the curtain spray applicators of this invention may be used in conjunction with other spray arrangements of the prior art to coat and/or rinse a piece of glass, e.g. the crossfire rinses as taught in the above-mentioned U.S. Pat. No. 3,793,054.

What is claimed is:

1. In a method of coating a planar surface of an article wherein the surface is coated by displacing the article in a downstream direction along an article movement path lying in a generally horizontal plane with the surface to be coated facing upwardly; applying a liquid rinsing medium to the surface of the article to rinse the surface by directing the rinsing medium downwardly to the surface as a plurality of atomized, conical sprays substantially aligned with and spaced from one another across the article movement path; and applying a liquid coating medium to the rinsed surface of the article to coat the surface; the improvement which comprises:

directing adjacent sprays of said plurality of sprays of rinsing medium toward the surface of the article such that the adjacent portion of the outer periphery of each of the adjacent sprays at the surface of the article is at the centroid of the next adjacent spray and such that the spray closest each marginal edge of the article surface overlies that edge; while adjusting and maintaining the sprays of rinsing medium to be of substantially equal force such that a peripheral portion of each spray is substantially aligned with a like peripheral portion of each other spray along a common line extending across the article movement path; and wherein the interactions of the adjacent sprays of rinsing medium provide a substantially linear spray front of substantially uniform rinse medium thickness across the surface of the article prior to the application of the coating medium to it.

2. The improved method as set forth in claim 1 wherein the coating medium is applied as a plurality of sprays in the manner by which the rinsing medium is applied and wherein the sprays are adjusted and maintained to provide for intercepting the sprays of the rinsing medium with the coating medium sprays along a substantially straight line of intersection at the surface of the article.

3. The improved method as set forth in claim 2 wherein the article is glass, the rinse medium comprises water and the coating medium comprises an aqueous electroless coating solution.

* * * * *